US006242689B1

(12) United States Patent
Budge

(10) Patent No.: US 6,242,689 B1
(45) Date of Patent: Jun. 5, 2001

(54) INTERLACED, COUNTER-ROTATING, MULTIPLE-HELIX CABLE

(75) Inventor: Tierry R. Budge, Orem, UT (US)

(73) Assignee: Farnsworth & Budge LLC, Draper, UT (US)

( * ) Notice: Subject to any disclaimer, the term of this patent is extended or adjusted under 35 U.S.C. 154(b) by 0 days.

(21) Appl. No.: 09/405,297

(22) Filed: Sep. 23, 1999

(51) Int. Cl.[7] ..... H01B 11/00
(52) U.S. Cl. ..... 174/27
(58) Field of Search ..... 174/27, 32, 36, 174/113 R, 34

(56) References Cited

U.S. PATENT DOCUMENTS

| | | | | |
|---|---|---|---|---|
| 411,137 | * | 9/1889 | Campbell | 174/32 |
| 615,349 | * | 12/1898 | Field | 174/32 |
| 995,588 | * | 6/1911 | Cuntz | 174/36 X |
| 4,208,542 | * | 6/1980 | Endo | 174/113 C |
| 4,767,890 | | 8/1988 | Magnan | 174/28 |
| 4,814,548 | | 3/1989 | Traversino et al. | 174/115 |
| 4,920,233 | | 4/1990 | Kincaid | 174/36 |
| 4,939,315 | | 7/1990 | Palmer | 174/36 |
| 4,994,686 | | 2/1991 | Brisson | 307/147 |
| 5,064,966 | | 11/1991 | Palmer | 174/32 |
| 5,109,140 | | 4/1992 | Nguyen | 174/36 |
| 5,110,999 | | 5/1992 | Barbera | 174/36 |
| 5,266,744 | | 11/1993 | Fitzmaurice | 174/103 |
| 5,393,933 | | 2/1995 | Goertz | 174/117 |
| 5,510,578 | | 4/1996 | Dunlavy | 174/128.1 |
| 5,523,528 | | 6/1996 | Bese et al. | 174/36 |
| 5,872,490 | | 2/1999 | Kamimura | 333/4 |

* cited by examiner

*Primary Examiner*—Dean A. Reichard
*Assistant Examiner*—Chau N. Nguyen
(74) *Attorney, Agent, or Firm*—Kirton & McConkie; Michael F. Krieger

(57) ABSTRACT

An improved cable for audio applications having multiple, interlaced, counter-rotating conductors in a twin helical pattern is disclosed. Preferred embodiments of the present invention include a first set of conductors configured into longitudinally offset, co-axial helices along with a second set of conductors configured into a substantially parallel group of longitudinally offset, co-axial helices which are interlaced with said first set of conductors such that, with each rotation of said helices, a conductor from the first set of helices overlaps and interlaces with a conductor from the second set of helices. The first and second sets of helices rotate in opposite directions to achieve proper interlacing engagement.

14 Claims, 5 Drawing Sheets

INTERLACED, COUNTER-ROTATING, MULTIPLE-HELIX CABLE

THE FIELD OF THE INVENTION

The present invention relates to the field of cables or wire for interconnection of high-fidelity audio components and power supply to these components. The present invention relates more particularly to multi-conductor cables containing groups of conductors arranged in a plurality of helically wound sets which are interlaced such that the circle of rotation of one helix overlaps with the circle or rotation of another. Preferred embodiments of the present invention also comprise drain wires which run longitudinally along the axis of each helix. In some embodiments of the present invention novel conductor configurations establish multiple ground planes or virtual grounds which improve cable performance.

BACKGROUND

Cables for high-fidelity audio systems typically transmit complex, multi-frequency, broad-band signals which effectuate the reproduction of intricate and detailed sounds. The premier goal of a high-fidelity sound system is to reproduce sound just as it was recorded. When an audiophile is satisfied that the highest quality audio components have been obtained attention is turned to the cable used for interconnection of these components.

It has long been known that signal distortion can occur in an audio transmission cable. This can be due to effects caused by electrical interference emitted by adjacent equipment such as television sets and cables and computer equipment including CPU's and monitors. Various shielding formats have been developed, such as co-axial cable formats, to reduce signal distortion from these sources and others.

Another distortion-causing problem found in audio interconnect cables is the so-called "skin effect" occurring with broad-band audio signals transmitted through multiple conductor cables. Prior art cables with multiple conductors exhibit an effect whereby high-frequency components of the audio signal tend to propagate toward conductors around the periphery of the cable while low-frequency components of the audio signal tend to propagate toward conductors in the center of the cable. The overall effect, thought to be caused by electromagnetic effects of signals in the periphery of the cable, results in signals around the periphery of the cable traveling faster than signals traveling along the center of the cable. This phenomenon results in a time distortion of the signal as high-frequency components arriving first at the destination followed by the low-frequency components which started at the same time as the high-frequency components. As a consequence, the signal arriving at the destination is distorted from the original signal.

Another problem found in audio cables is excessive impedance. Impedance, in audio cable, can come from the inherent resistance of the wire and the material it is constructed from as well as the inductive effects of the cable which derive significantly from the geometric configuration of the cable elements.

What is needed is a cable which is highly resistant to externally induced distortion, which minimizes the distortion caused by "skin-effect" and which can be configured to minimize internal impedance in the cable.

SUMMARY AND OBJECTS OF THE INVENTION

The present invention comprises a multi-conductor cable for transmission of broad-band electrical signals and power without significant distortion or attenuation of the signal. The cable of the present invention may be used in power applications and for transmission of digital signals. The cable comprises a plurality of counter-rotating helices each containing a plurality of conductors wherein the cross-sectional shape of each helix intersects with that of another such that the conductors in each helix are interlaced with another or with a common conducting element.

Embodiments of the present invention comprise multiple counter-rotating helices with wires which interlace with each other forming a physical link between the helices. Interlacing may occur between the helically wound conductors of each helix or it may occur by interlacing helical conductors around a common drain wire or other element which acts as a common element between the helices.

Some embodiments of the present invention also comprise drain wires which are not interlacing elements and which run longitudinally within or adjacent to the helices. Shielding may also be employed to help reduce noise from external sources.

Accordingly, it is an object of some embodiments of the present invention to provide a cable which reduces signal distortion.

It is another object of some embodiments of the present invention to provide a cable which reduces signal attenuation.

It is yet another object of some embodiments of the present invention to provide a cable with multiple ground planes.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

In the following description, preferred embodiments of the present invention are described by referring to functional diagrams, schematic diagrams, functional flow charts, program flow charts and other graphic depictions which help to illustrate either the structure or processing of preferred embodiments used to implement the apparatus, system and method of the present invention. Using the diagrams and other depictions in this manner to present the invention should not be construed as limiting of its scope.

Because a cable must flex and bend according to its path, shapes, such as the helices formed by conductors in the cable, may distort and deform so that they no longer form a perfect rendition of the described shape. Geometric terms such as helix, circle, ellipse and others used in this document are used to describe the general shape of an element or object in a theoretically perfect embodiment of the invention. Actual embodiments of the present invention may vary substantially from the mathematically perfect shapes described. Therefore, geometrical and mathematical terms used in this document are to be interpreted as encompassing variations and distortions of the terms which generally follow the approximate description of the term.

Figure 1:
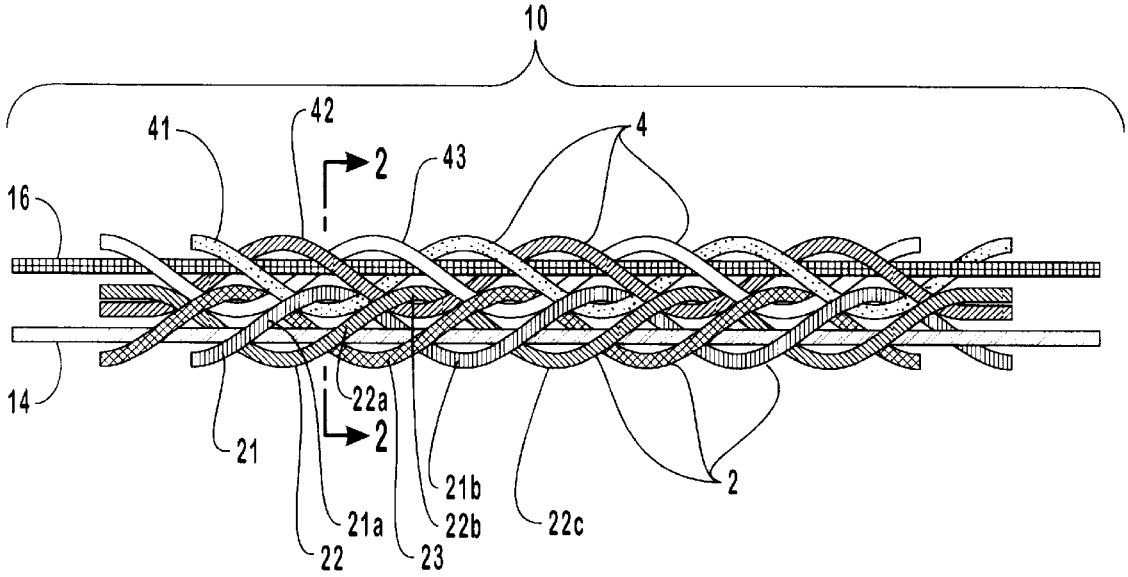
FIG. 1 is a side view of the cable of a first embodiment of the present invention shown with drain wires.

In reference to FIG. 1, a preferred embodiment of the present invention comprises a cable 10 with a first set of conductors 2 which are configured in a substantially helical pattern which rotates in a counter-clockwise direction as it travels from left to right across the page. This embodiment further comprises a second set of conductors 4 of equal number to the first set of conductors in set 2 and also configured in a substantially helical pattern but which rotates in a clockwise direction as it travels from left to right across the page such that the second set of conductors 4 counter-rotates relative to the first set of conductors 2.

Figure 2:
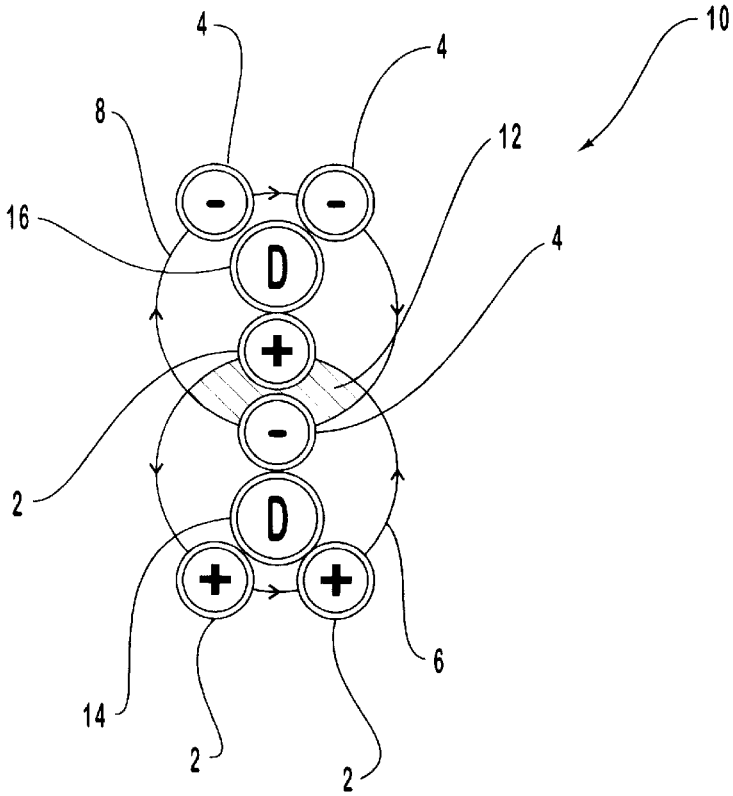
FIG. 2 is a cross-sectional view of the cable shown in FIG. 3.

As each of the conductors follows its helical path, the path creates a shape of rotation as viewed in transverse cross-section, such as is shown in FIG. 2. The outline of this shape of rotation and others formed by other helices of the present invention may, in practical applications, become distorted such that it's form changes along the length of the cable. The shape of rotation may form an oval shape, a pear shape, an oblong shape or even a triangular shape or other variations. These shapes are to be considered within the scope of the terms "shape of rotation," "path of rotation" and similar terms as used in this document.

The first set of conductors 2 follows a counter-clockwise path creating an approximately circular path of rotation 6 as viewed in cross-section. At any cross-section along the longitudinal length of cable 10, the conductors in this first set of conductors 6 will be positioned along this path of rotation. The conductors in the second set of conductors 4 rotate in an opposite, clockwise direction also forming an approximately circular path of rotation 8 in which all conductors in the second set of conductors 4 will rest at any point along the length of cable 10. It should be noted that, in a practical application, the conductors may not follow a perfect circular path, but may deviate from a circle to accommodate bends and other variations in the cable and its position as well as variations in the weave of the cable. The actual pitch of the helices may also vary in practical use thereby distorting the location and proximity of the conductors along the cable length.

These two sets of helically wound conductors 2 & 4 are positioned relative to one another such that the path of rotation 6 of the first set of conductors overlaps the path of rotation 8 of the second set of conductors. This overlap 12 allows the two sets of conductors to be interlaced such that conductors in one set cross over the conductors in the other set thereby causing the two helically wound sets of conductors 2 and 4 to be physically joined together in a type of weave. In this manner the first set of conductors 2 and the second set of conductors 4 are physically joined by the interlaced wiring. In a preferred embodiment, all conductors in one set of conductors 2, are interlaced with a corresponding conductor in a different set of conductors 4.

It should be noted that while the preferred embodiments of the present invention shown in FIGS. 1 to 6 show only two sets of conductors, more conductor sets may be used in other embodiments of the present invention.

In reference to FIGS. 1 and 2, preferred embodiments of the present invention may also comprise drain wires 14 & 16 which may serve as ground wires, primary conductors or may be used to transmit control signals or other communications. These drain wires 14 & 16 may also be used as impedance matching elements as required by specific cable applications.

Figure 4:
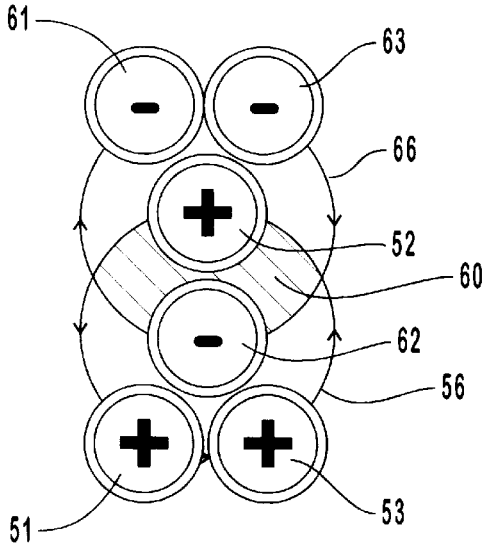
FIG. 4 is a cross-sectional view of the cable shown in FIG. 3.
Figure 6:
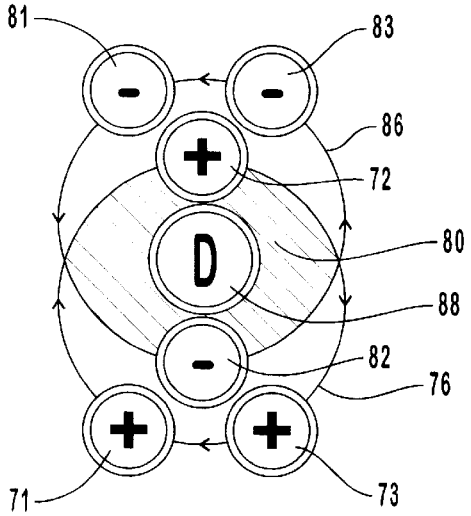
FIG. 6 is a cross-sectional view of the cable shown in FIG. 5.

All conductors in the cable of preferred embodiments of the present invention are insulated as shown in FIGS. 2, 4 and 6 by the double circle around each conductor and drain wire.

In reference to FIG. 1, which depicts a first embodiment of the present invention with three conductors per helix or set 2 & 4, the conductors can be seen in side view. Conductors 21, 22 and 23 of the first helix or set 2 can be seen as they follow their helical path along the length of the cable. A first conductor 21 of first set of conductors 2 follows a helical path around drain wire 14 and continues to position 21*a*, where it crosses over fourth conductor 41 and wraps around fourth conductor 41, thereby interlacing therewith, as it follows its path back under drain wire 14 to position 21*b* at the outside of drain wire 14.

Second conductor 22, of first set 2, follows a virtually identical, but with a longitudinally offset path as it winds around drain wire 14 at position 22*a* and continues toward the center of the cable and position 22*b* where it crosses over fifth conductor 42 wrapping around conductor 42, thereby interlacing therewith, and returning to position 22*c* at the outside of drain wire 14. Third conductor 23, of set 2, follows a similar path thereby interlacing itself with sixth conductor 43 as it follows its helical path. In this manner, one conductor in each helix is interlaced with a corresponding conductor in another helix each time their helices overlap as they pass through the interior of the cable.

Drain wire 14 and 16 are generally parallel to one another and follow a longitudinal path that approximately follows the axis of the helices formed by the conductors of sets 2 and 4. The path of drain wires 14 and 16 may vary along the path of cable 10 and will particularly vary within the path of rotation of their respective conductors sets 2 and 4, however, drain wire 14 will remain substantially within the path of rotation 6 of conductor set 2 and, likewise, drain wire 16 will remain substantially within the path of rotation 8 of conductor set 4. Additional drain wires (not shown) may also be used in embodiments of the present invention either within the helices formed by conductors or outside the helices.

Figure 3:
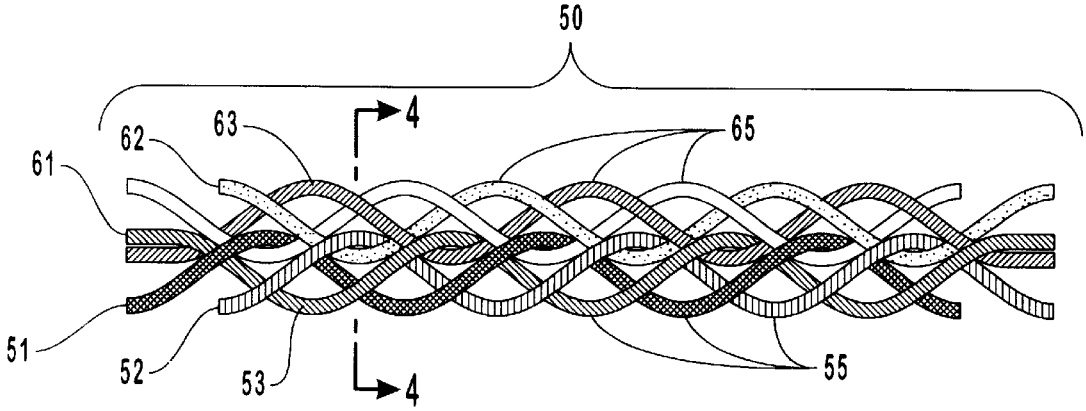
FIG. 3 is a side view of the cable of a second embodiment of the present invention shown without drain wires.

An alternative, second embodiment of the present invention, shown in FIGS. 3 and 4, utilizes a similar interlaced geometric configuration, however this alternative embodiment does not comprise drain wires. This second embodiment comprises a first set of conductors 55 interlaced with a second set of conductors 65.

A first conductor 52 of the first set of conductors 55 follows an approximately helical path in a counter-clockwise direction as it travels from left to right across the page in FIG. 3. As conductor 52 follows its helical path, conductor 52 creates a cross-sectional shape of rotation 56 which outlines the path followed by conductors in first set 55. Corresponding conductor 62 follows a similar, but counter-rotating path adjacent to that of conductor 52 thereby creating a cross-sectional shape of rotation 66 followed by conductors in a second set 65. Shape of rotation 66 and shape of rotation 56 overlap at an interlacing zone 60 where the conductors from the first set 55 may physically contact, interact, cross over, and interlace with conductors in second set 65. In interlacing zone 60, conductor 52 in set 55 crosses over and interlaces with conductor 62 in set 65 thereby creating a physical interlock between set 55 and set 65 which binds the set together.

Each conductor in set 55 has a corresponding conductor in set 65 with which it interlaces. Conductor 51 interlaces with corresponding conductor 61 and conductor 53 interlaces with corresponding conductor 63. In the preferred embodiments shown in FIGS. 1 to 6, interlacing follows a repetitious pattern each time the conductors simultaneously enter the interlacing zone 60, however, other patterns of interlacing, including but not limited to, intermittent interlacing may also be used in alternative embodiments.

Figure 5:
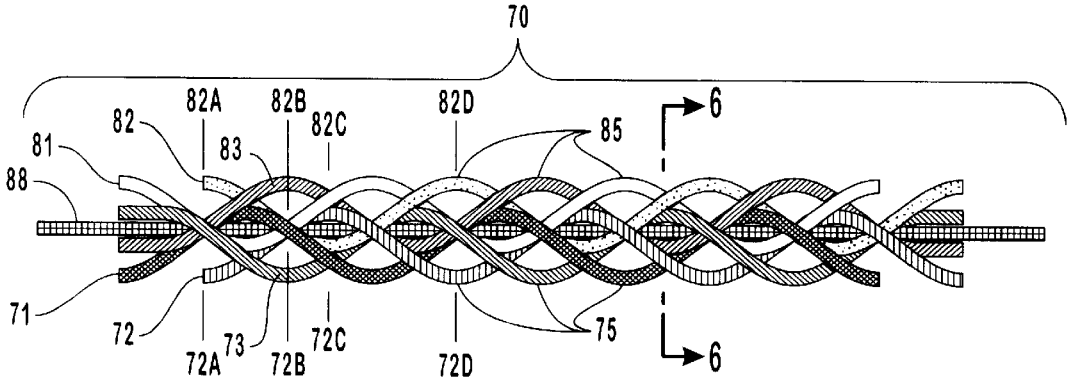
FIG. 5 is a side view of the cable of a third embodiment of the present invention shown with a single interlacing drain wire.

In reference to FIGS. 5 and 6, a third embodiment of the present invention comprises a central drain wire 88 which extends longitudinally along the approximate center of cable 70. Central drain wire 88 also acts as an interlacing element around which conductors in separate helically wound sets 75 and 85 wrap. In this embodiment, conductors 75 in a first set of conductors do not directly interlace with conductors 85 in a second set of conductors. Instead, conductors 75 interlace with drain wire 88 and conductors 85 interlace with drain wire 88 making drain wire 88 a common interlacing element which physically ties conductors 75 to conductors 85.

This third embodiment comprises a first set of conductors 75 comprising conductors 71, 72 and 73 which are configured in a first helical pattern which rotates in a first helical direction which is clockwise in this example of a third embodiment. A second set of conductors 85 comprises conductors 81, 82 and 83 which are configured in a second helical pattern which rotates in a direction opposite to the first helical direction of first set of conductors 75 such that, in this example, the helical rotation is counter-clockwise.

As each conductor in each set of conductors 75 and 85 follows its helical path, each conductor passes around drain wire 88 forming a physical link therewith. For example, conductor 72 in first conductor set 75 passes, from left to right in FIG. 5, from a first outboard position 72A, and rotates downward below drain wire 88 at position 72B. Conductor 72, then, rotates up and around drain wire 88 at position 72C, shown in FIG. 5 and in cross-section in FIG. 6, and continues rotating until it reaches a second outboard position 72D where it begins another rotation sequence.

In second conductor set 85, conductor 82 follows a similar path to conductor 72, but in a counter-rotating direction. Beginning at position 82A and progressing from left to right in FIG. 5, conductor 82 passes from a first outboard position 82A and rotates downward passing below drain wire 88 at position 82B, then rotates upward and around drain wire 88 at position 82C, shown in FIG. 5 and in cross-section in FIG. 6. Conductor 82 continues its helical path by rotating upward and outward to a second outboard position 82D from which it begins another rotational sequence.

This third embodiment of the present invention may also comprise additional drain wire placed within or without the helical shapes of rotation of the conductor sets. The conductor sets 75 and 85 may also comprise quantities of conductors that are greater or less than the quantity shown in this example of the embodiment.

Figure 7:
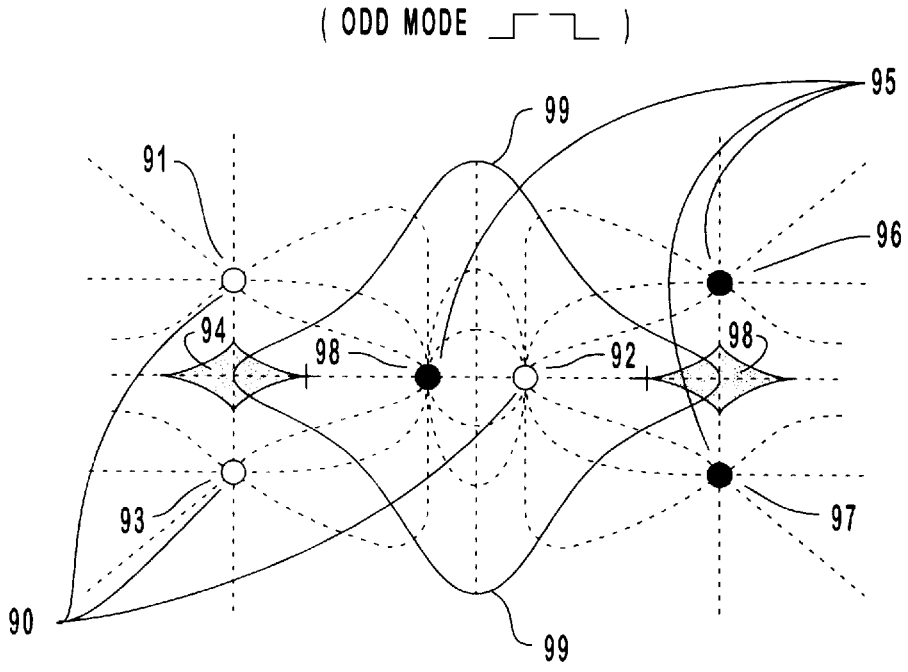
FIG. 7 is an electromagnetic diagram of the field generated by the cable of the second embodiment of the present invention shown in FIGS. 3 and 4 with odd mode signals.

FIG. 7 depicts an electromagnetic diagram of the cable of the second embodiment of the present invention shown in FIGS. 3 and 4 which does not have drain wires. FIG. 7 is an odd mode diagram which shows the presence of three virtual grounds. In reference to FIG. 7, a first set of conductors 90 and a second set of conductors 95 are shown in crossection section as they are arranged in the second embodiment of the present invention. When an odd mode signal is transmitted through the cable of this embodiment, three virtual grounds are established. A first virtual ground 94 is established at the approximate midpoint between conductors 91 and 93. A second virtual ground 98 is established at the approximate midpoint between conductors 96 and 97. A third virtual ground is established in what appears as an oblong diamond shape 99 around the central conductors 92 and 98.

Figure 8:
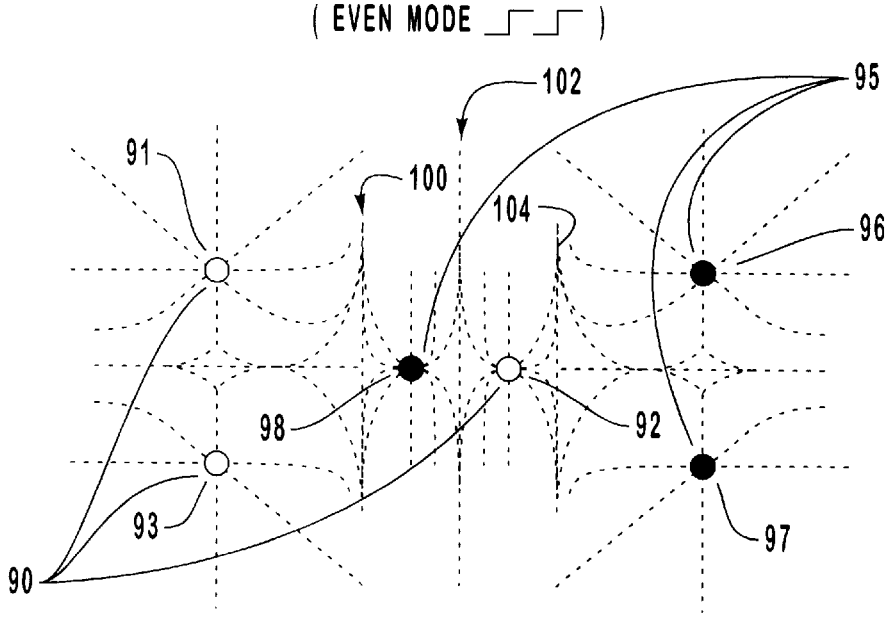
FIG. 8 is an electromagnetic diagram of the field generated by the cable of the second embodiment of the present invention shown in FIGS. 3 and 4 with even mode signals.

FIG. 8 also depicts an electromagnetic diagram of the cable of the second embodiment of the present invention showing the presence of three virtual opens. In reference to FIG. 8, a first set of conductors 90 and a second set of conductors 95 are shown in cross-section as they are arranged in the second embodiment of the present invention. When an even mode signal is transmitted through the cable of this embodiment, three virtual opens are established. A first virtual open 100 is established between central conductor 98 of second set 95 and conductors 91 and 93 of first set 90. A second virtual open 102 is established at the approximate midpoint of the cable between central conductors 98 and 92. A third virtual open is established between central conductor 92 of first set 90 and conductors 96 and 97 of second set 95.

Figure 9:
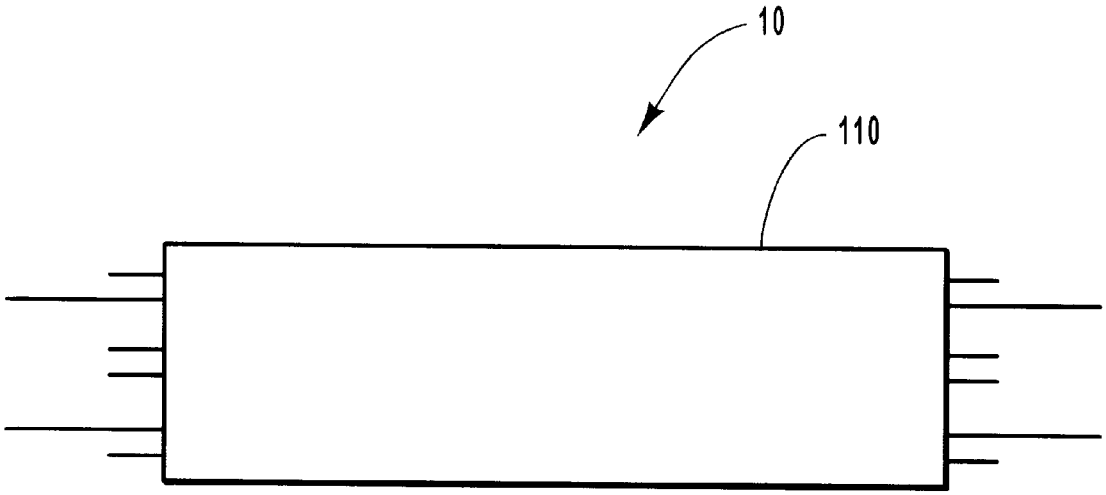
FIG. 9 is a side view of the cable in a conductive sheath in accordance with the present invention.

Each conductor wire 10, 50, or 70, may be sheathed in a conductive shielding 110 as shown in FIG. 9. The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. A cable for signal and power transmission comprising:

a first set of conductors wound in a first helical pattern along a first axis, said first pattern rotating in a first direction of rotation; and a second set of conductors wound in a second helical pattern along a second axis, said second helical pattern rotating in a direction of rotation opposite to said first direction of rotation;

said first set of conductors being interlaced with said second set of conductors generally along a center axis between the first and second axis.

2. The cable of claim 1 further comprising one or more supplementary conductors extending longitudinally through the center of one or more of said helical patterns.

3. The cable of claim 1 wherein each of said conductors is insulated.

4. The cable of claim 1 wherein each of said sets of conductors comprises three conductors.

5. A signal transmission cable comprising:

one or more first conductors arranged in a clockwise rotating helical pattern having a first axis; and one or more second conductors arranged in a counter-clockwise rotating helical pattern having a second axis;

wherein said first conductors are interlaced with said second conductors generally along a center axis between the first and second axes.

6. The cable of claim 5 wherein said helical pattern of said first conductors overlaps said helical pattern of said second conductors such that each conductor in said one or more first conductors interlaces with a conductor in said one or more second conductors forming a continuous interlacing along the length of said cable.

7. The cable of claim 5 wherein said helical pattern of said first conductors is substantially parallel with said helical pattern of said second conductors.

8. The cable of claim 5 wherein said helical pattern of said first conductors is situated in a side by side adjacent relationship to said helical pattern of said second conductors.

9. The cable of claim 5 wherein said helical pattern of said first conductors is situated in a side-by-side parallel and adjacent relationship to said helical pattern of said second conductors and wherein the shapes of rotation of said conductors.

10. An audio cable comprising:

a first insulated conductor in the shape of a first helix, said helix having a first longitudinal axis, a first cross-sectional shape of rotation, a first helical pitch and a first rotational direction;

a second insulated conductor in the shape of a second helix, said helix having a second longitudinal axis, a second cross-sectional shape of rotation, a second helical pitch and a second rotational direction opposite to said first rotational direction;

said first conductor and said second conductor being configured such that said first longitudinal axis and said second longitudinal axis are substantially parallel, and such that said first shape of rotation and said second shape of rotation overlap forming an overlap area, and said first helix and said second helix being coordinated with equal helical pitches such that said first conductor and said second conductor enter said overlap area at the same longitudinal location on each revolution of said helices such that said first conductor overlaps and interlaces with said second conductor at each revolution of said helices.

11. The audio cable of claim 10 further comprising one or more pairs of additional helically shaped conductors, each of said pairs having a first additional conductor whose helical shape is co-axial with said first helical shape and with equal helical pitch thereto and a second additional conductor whose helical shape is co-axial with said second helical shape and with equal helical pitch thereto such that said pairs overlap and interlace at each revolution of their helices in similar fashion to said first and second conductors.

12. The audio cable of claim 10 further comprising one or more longitudinal conductors which pass through the center of said helices.

13. The audio cable of claim 10 further comprising conductive shielding.

14. The audio cable of claim 13 wherein said shielding surrounds said conductors.

* * * * *